United States Patent [19]

Cole

[11] Patent Number: 4,896,581

[45] Date of Patent: Jan. 30, 1990

[54] ACCURIZER

[76] Inventor: Richard Cole, P.O. Box 197, S. Harpswell, Me. 04079

[21] Appl. No.: 292,452

[22] Filed: Dec. 30, 1988

[51] Int. Cl.[4] ..... F41F 17/12; F41D 10/08

[52] U.S. Cl. ..... 89/196; 89/163

[58] Field of Search ..... 89/196, 163, 14.3; 42/100

[56] References Cited

U.S. PATENT DOCUMENTS

| | | | |
|---|---|---|---|
| 708,794 | 9/1902 | Browning | 89/163 |
| 808,008 | 12/1905 | Browning | 285/88 |
| 898,038 | 9/1908 | Clarus | 89/196 |
| 1,382,197 | 6/1921 | Jolidon | 89/163 |
| 1,896,820 | 2/1933 | Jolidon | 89/163 |
| 3,158,064 | 11/1964 | Charron | 89/196 |
| 3,756,121 | 9/1973 | Roy | 89/196 |
| 4,344,352 | 8/1982 | Yates et al. | 89/163 |
| 4,811,648 | 3/1989 | Blackwell et al. | 89/14.3 |

FOREIGN PATENT DOCUMENTS

| | | | |
|---|---|---|---|
| 1474832 | 2/1967 | France | 89/14.3 |
| 330365 | 7/1936 | Italy | 89/14.3 |

*Primary Examiner*—Harold J. Tudor
*Assistant Examiner*—Stephen Johnson
*Attorney, Agent, or Firm*—Sherman Levy

[57] ABSTRACT

An accurizer is provided for improving the accuracy of handguns by eliminating or lessening the potential misalignment of the barrel from which a projectile is fired and the sights used by the operator to aim at the target. There is provided a barrel having a modified area having an outside surface machined down and threaded. There is further provided a bushing having an outside tapered surface and inside threaded surface. A slide is provided having an inside surface tapered to fit the bushing.

3 Claims, 1 Drawing Sheet

FIG. 1
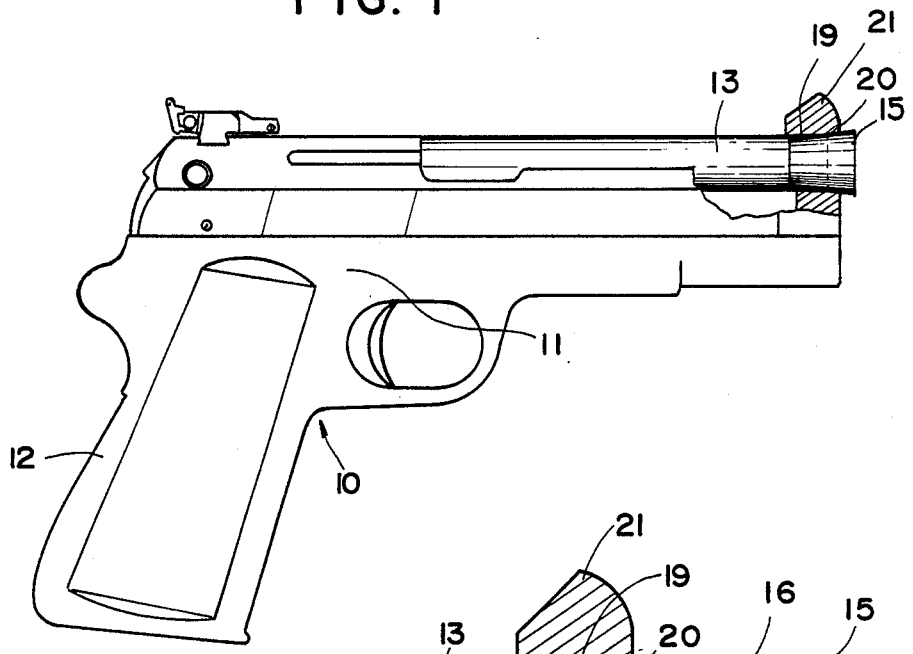
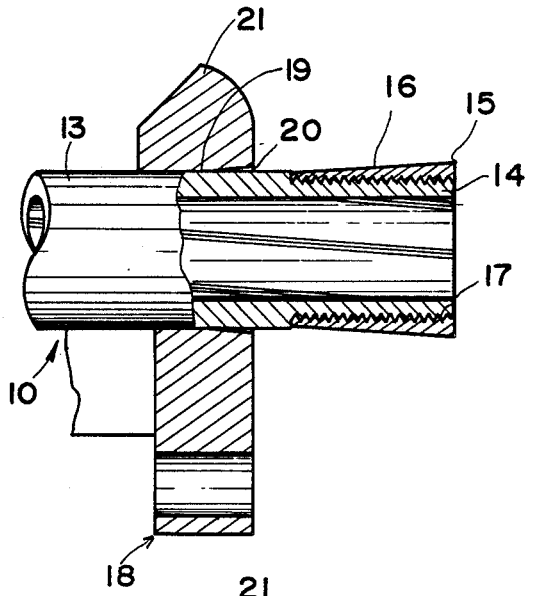
FIG. 2
FIG. 3
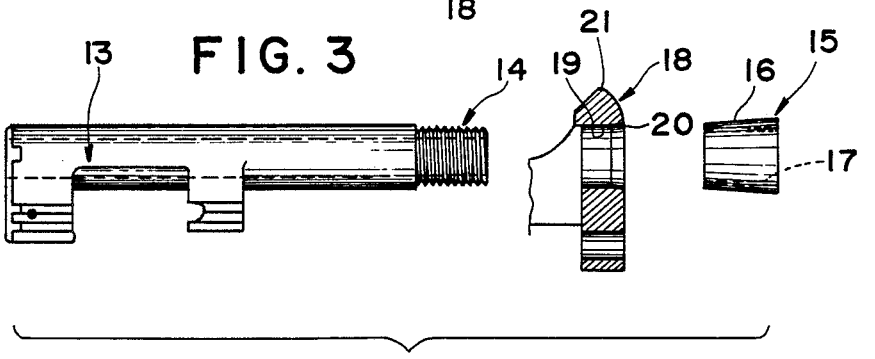

ACCURIZER

BACKGROUND OF THE INVENTION

The present invention relates to improving the accuracy of automatic weapons such as handguns, and the class of handguns to which the accurizer is adaptable or applicable includes most semi-automatic weapons of variable calibers which incorporate a design in which a slide-barrel recoil assembly is used. In such guns the barrel moves inside the slide. Typically, the initial round is loaded into the firing chamber by manually pulling the slide rearward against the recoil spring or other energy storing mechanism; upon release the slide moves forward to chamber the round and locks the barrel-slide assembly. Subsequent rounds are similarly chambered by the action of compressed gases from a fired round which also recoil the barrel a short distance (relative to slide travel), retract the spent cartridge case, and cause the rearward travel of the slide. The sights used by the operator to aim at an intended target, are a part of or affixed to the slide. The barrel, through which the projectile is fired, is a separate part. Thus, any misalignment of the slide and barrel while in the firing position (up, down, right, or left) will lessen accuracy.

DESCRIPTION OF THE PRIOR ART

Various kinds of firearms have been provided with means for trying to improve the accuracy thereof, as for example as shown in prior U.S. Pat Nos.:

| | |
|---|---|
| 1,348,284 | 3,252,237 |
| 2,935,000 | 3,564,967 |
| 3,411,406 | 3,731,590 |
| 3,110,223 | 3,975,982 |
| 3,411,407 | 4,178,833 |
| 3,411,408 | 4,222,308 |

However, neither these prior patents nor any others known to Applicant achieve the results accomplished by the present invention.

OBJECTS AND SUMMARY OF THE PRESENT INVENTION

A primary object of the present invention is to provide an accurizer for improving the accuracy of a specific class of handguns by eliminating or lessening the potential misalignment of the barrel from which a projectile is fired and the sights used by an operator to aim at the target. The class of handguns to which the accurizer is adaptable or applicable includes most semi-automatic weapons of variable calibers which incorporate a design in which a slide-barrel recoil assembly is used. This is accomplished by providing the barrel with a modified area having an outside surface machined down and threaded, as well as providing a bushing having an outside tapered surface, and an inside threaded surface. Further, there is provided a slide having an inside surface tapered to fit the outside tapered surface of the bushing.

Another object of the present invention is to provide an accurizer which eliminates misalignment of the barrel and sights by providing a positive and reproducible mating of barrel and slide in the firing position. This is accomplished by modification of both the slide and the barrel at their muzzle ends and the addition of a threaded tapered bushing into the barrel.

A still further object of the present invention is to provide an accurizer wherein the internal surface of the muzzle end of the slide is machined down for a short length to a reduced diameter appropriate to its bore and outside diameter. This reduced outside surface is threaded.

A still further object of the present invention is to provide an accurizer that can be manufactured inexpensively and which will accomplish the desired purposes with maximum efficiency. These and other objects of the present invention will become apparent with references to the drawings, the description of the preferred embodiments and the appended claims.

BRIEF DESCRIPTION OF THE DRAWINGS

FIG. 1 is a side elevational view of a handgun provided with the accurizer of the present invention and with parts broken away and in section.

FIG. 2 is a fragmentary sectional view on an enlarged scale illustrating the barrel and bushing and slide.

FIG. 3 is an elevational view with parts broken away and in section illustrating the accurizer of the present invention and showing the parts separated.

DESCRIPTION OF THE PREFERRED EMBODIMENTS

Referring in detail to the drawings, the numeral 10 indicates a handgun which includes the usual body 11, handle portion 12 and barrel 13. The barrel 13 has a modified area 14 wherein the outside surface thereof is machined down and threaded for a purpose to be later described.

The numeral 15 indicates a bushing that has an outside surface tapered as at 16, and the inside surface of the bushing is threaded as at 17.

As shown in the drawings the numeral 18 indicates a slide having an inside surface 19 tapered at its forward end portion 20 to fit the bushing 16. The numeral 21 indicates a sight on the slide.

The parts can be made of any suitable material and in different shapes and sizes as desired or required.

From the foregoing it will be seen that there has been provided an accurizer which improves the accuracy of a specific class of handgun by eliminating or lessening the potential misalignment of the barrel from which a projectile is fired, and the sights used by the operator to aim at the target.

It is to be noted that the class of handguns to which the accurizer is adaptable/applicable includes most semi-automatic weapons of variable calibers which incorporate a design in which a slide-barrel recoil assembly is used. In such guns, the barrel moves inside the slide. Typically, the initial round is loaded into the firing chamber by manually pulling the slide rearward against a recoil spring or other energy-storing mechanism; upon release, the slide moves forward to chamber the round and locks the barrel-slide assembly. Subsequent rounds are similarly chambered by the action of compressed gases from a fired round which also recoil the barrel a short distance (relative to slide travel), retract the spent cartridge case and cause the rearward travel of the slide.

Further, the sights, used by the operator to aim at an intended target, are a part of or are affixed to the slide. The barrel, through which the projectile is fired, is a separate part. Thus, any misalignment of the slide and barrel while in the firing position (up, down, right or left) will lessen accuracy. (A sighting deviation of 1/64"

over a 4" barrel length [due to misalignment, wear or other factors] has a potential target deviation of plus or minus 3.51 inches at 75').

In addition, the accurizer eliminates this misalignment by providing a positive and reproducible mating of the barrel and slide in the firing position. This is accomplished by modification of both the slide and the barrel at their muzzle ends and the addition of a threaded tapered bushing onto the barrel.

a. The muzzle end portion of the barrel has its external surface machined down for a short length to a reduced diameter appropriate to its bore and outside diameter. This end surface portion of reduced outside diameter is threaded.

b. A tapered bushing is provided. Its internal bore is threaded to mate with the threads on the end surface portion of reduced diameter of the barrel. Its length is at least that of the newly machined length of the barrel end portion. Its outside diameter is tapered from a diameter of that of the outside diameter of the barrel at the undiminished portion of the barrel to a larger outside diameter at the forwardmost point of the bushing. Thus, when it is threaded onto the modified barrel, the assembly has the original length of the barrel (or greater) and it flares to a larger, outside diameter at its muzzle end.

c. The internal surface of the muzzle end of the slide is machined to provide a taper identical to that of the outside surface of the tapered bushing which has been added to the barrel such that, in the firing position, the modified slidebarrel assembly is in positive alignment forward end portion 20 of inside surface 19 of slide 18 tightly engaging tapered outside surface 16 of bushing 15, looseness having been eliminated.

It is to be noted that subsequent use of the modified weapon will eventually cause wear of the bushing-slide mating surfaces that will lessen the accuracy that has been improved by the accurizer. Simple removal of the bushing and facing its rearmost surface will restore positive mating of the slide-barrel surfaces.

As shown in the drawings with further reference to barrel 13 the area 14 is modified so that the outside surface of modified area 14 is machined down and threaded. As to the bushing 15, the outside surface 16 is tapered, and the inside surface is threaded as at 17 to mate with the threaded outside surface of modified area 14 of barrel 13, as shown in FIG. 2. With reference to the slide 18, the inside surface 19 is tapered at its forward end portion 20 to fit the bushing 15.

Applicant's invention possesses certain important differences and advantages not found in the prior patents. For example, in prior Korzeniewski U.S. Pat. No. 3,252,237 for a gun barrel seating device, this patent to Korzeniewski is primarily a system for positioning the breech end, which is the rear end of the barrel, and wherein the pistol barrel may be locked in a limiting upper position for accurately positioning the rear end of the barrel of the pistol in place. This prior patent to Korzeniewski is completely opposite from the present invention because in the present invention the muzzle end of the barrel is being worked on rather than the breech end of the barrel so that there is no similarity between the present invention and Korzeniewski. It is well known that within the firearm industry there is more deviation in bullet flight from any wobble or play at the muzzle than there is at the breech, and this can be mathematically determined by basic geometry.

Considering the prior patent to Mowrey, No. 2,935,000, Mowrey is a "Combination Torque and Recoil Compensator and Barrel Bushing for Guns." In Mowrey there is provided a bushing that is used in the government model 1911 pistol which was designed by John Browning, and was manufactured by the Colt Company and was called "The Colt Automatic 45." This is basically a recoil compensator which has been added to the bushing. In paragraph 2 Mowrey states, "An object of this invention is to provide a recoil and torque compensator and barrel bushing that will compensate for the torque created by the rifling of the bullet in the gun barrel and which will maintain the muzzle of the gun at a substantially uniform steadiness during the discharge of the cartridges therefrom." Mowrey thus provides in the first part for the compensating effect, and he is venting the gas off out of the top and at an angle to try and compensate for some of the spiraling torque effect from the bullet's movement from the barrel. Mowrey claims close tolerances so that it appears that there would be some possibility of hand fitting of the bushing which is commonly done on any accurized Colt type guns and that is always one of the first things that is done. Again, this bushing is a Colt style bushing, and the bushing surrounds the barrel rather than the bushing being on the barrel, and that is a primary difference between the bushing used by Applicant and the bushing described in Mowrey.

As to La Violette, U.S. Pat. No. 3,564,967, this is a pistol barrel positioning means wherein the bushing has a cylindrical shape the same as a Colt bushing. However, it is serrated longitudinally and has spring fingers. The barrel itself does have a tapered shoulder which is machined onto the barrel. The spring fingers apply tension to the barrel and that is the means for securing the barrel in basically the same place every time the gun is fired. Again, this is an alteration of the basic Colt bushing and the barrel goes through the bushing rather than providing a bushing on the barrel. The only similarity here is that La Violette uses a taper on the barrel. However, the crux of La Violette is the bushing with the spring fingers.

In FIG. 8 of La Violette there is illustrated a different concept or embodiment wherein they have tapered the inside of the slide and affixed the spring fingered bushing to the barrel and this is just a reversal of the concept. Thus, on one form of La Violette's device, they have the taper on the barrel and on the other they have the taper on the slide and in both cases they are using a spring fingered bushing. They are not using the taper to mate the barrel in the slide like Applicant and that is an important difference. Applicant uses two tapered surfaces which touch each other. In La Violette they provide a partially resilient bushing and this is what they refer to over and over again, to a plurality of resilient fingers. In claims 6 and 7 of La Violette they call for a sloped surface whereas Applicant uses two sloped surfaces bearing together to which reference is made as being a tapered fit.

In the Pachmayr et al, U.S. Pat. No. 3,411,406, Pachmayr et al uses a bushing which is affixed to the slide, the barrel being a straight barrel, and the gun being a 1911 government model. The barrel is a straight barrel and there is no protrusion anywhere, and if anything the barrel slides through a bushing which is affixed to the slide. In the Pachmayr et al, U.S. Pat. No. 3,411,406, there is a gun having a slide mounted for recoiling movement relative to the receiver of the gun and relative to a barrel whose breech end swings slightly downward on recoil. That is not the type of gun that Applicant is working with at all because on the 92 Beretta style gun, the breech of the gun does not swing downward at all. It runs back and forth parallel to the frame at all times. Thus in this patent they are working with a bushing that is affixed into the slide that the barrel slides through, rather than with any bushing that is affixed to the barrel.

In the Pachmayr et al, U.S. Pat. No. 3,411,408, there is a "Mounting Structure for Pistol Barrels" and in this patent they are using the same identical bushing as the first Pachmayr U.S. Pat. No. 3,411,406. However, they have changed the means of affixing the bushing to the slide. In both of the Pachmayr patents that are being discussed, the bushing is a spherical type bushing. The spherical shape and due to the fact that the breech moves downward in the type of pistol that they are working with here during the unlocking of the gun is such that as the gun is fired, the spherical shape of the bushing allows the muzzle of the barrel to pivot inside the slide. With the system that Applicant has there would be no such requirement.

In the Pachmayr et al, U.S. Pat. No. 3,411,407, "Gun Slide Guiding Device" Pachmayr returns back to a Colt style bushing, which is a sleeve which goes inside the slide and surrounds the bearing; again the bushing is affixed to the slide. There are no tapers involved in this arrangement. In this patent, he states a major object of his invention is to provide a device for overcoming difficulties in the movement between the slide and the frame. That is a major difference.

Pachmayr is not trying to stabilize the muzzle, in this patent, that is what he was working on in his other two patents. In this patent, No. 3,411,407, Pachmayr is trying to stabilize the fit between the slide and the frame.

As to Loomis, U.S. Pat. No. 1,348,284, this is a "Slide Bushing For Pistols," and is for older types of pistols. The bushing is permanent bushing and is put on the gun and stays there. This bushing could never be a tapered bushing, because in order to disassemble a 92 style pistol, if the tapered bushing is used it would have to be removable in order to remove the barrel from the slide in the disassemble sequence. Basically in Loomis they are using the barrel which is cylindrical, and the inside of the bushing is cylindrical and the bushing is put into the face of the slide—in the muzzle of the slide—and then they are using a punch to expand it on the inside of the slide and once it is expanded there it is like a suede fit and is not removable at that point any more. No tapers are involved for any kind of increase in accuracy.

As to Terstegge, U.S. Pat. No. 3,975,982, this is referred to as "A Firearm with Accurizing Means," and Terstegge is a basic Colt type bushing which is slotted, and a tapered slide piece 49 is affixed in place. When the gun is used, that piece slides into the slotted bushing and there is no play side to slide play, and pressure is applied upwardly to the top of the bushing. There is a major difference between Terstegge and Applicant, in that Applicant is working with a taper fit. A taper fit provides pressure radially all around the barrel and the slide together, there is no tension on one point more than there is on another. In this Terstegge patent they are working with the 1911 Colt style pistol. Another difference is that the Colt bushing is affixed to the slide rather than a bushing affixed to the barrel. The only thing affixed to the barrel is a small triangular shaped object sticking out of the bottom, and with further reference to part 49, there is a major difference between Terstegge's patent and Applicant's invention.

With reference to Zimmerman, U.S. Pat. No. 3,731,590, this is referred to as "Improvements in Reciprocating Slide Type Handgun Automatic Firearms." Zimmerman is a complicated arrangement and has many moving parts.

Zimmerman is basically working with the 1911 model pistol. The bushing is basically again, the Colt style bushing which fits inside the slide and is retained by the recoil spring plunger. Zimmerman would be quite expensive to make or sell.

In Arnett, U.S. Pat. No. 4,222,308, this is an "Accuracy Device for Semi-Automatic Pistols," and he has tapering surfaces on the barrel tenon and the tenon engaging recess. Arnett is working with the breech of the barrel and slide rather than with the muzzle. Arnett is trying to provide a method to which the breech of the barrel and the slide sit themselves in the same position each time the gun is fired. There is more advantage to stabilizing the muzzle of the barrel and the slide than there is in the breech, and even though Applicant and Arnett are both working on stabilizing things, Applicant is stabilizing the other end of the gun. In Arnett he uses a Colt style bushing.

In the Miller U.S. Pat. No. 4,178,833, there is a "Snap Ring Bearing for a Gun Barrel Bushing," and he provides a steel snap ring bearing between the gun barrel and the barrel bushing to remove the relative play therebetween, and thus accurately position the barrel relative to the sights on the slide to improve its aiming characteristics. Miller is trying to stabilize the muzzle and he is using the basic Colt bushing, and he is putting a groove and a snap ring recess into the muzzle of the barrel, and he puts a snap ring in so that when the barrel moves through the slide as it comes back in the battery, the snap ring applies tension to the bushing. A snap ring has inherent play due to the fact that it is a snap ring it has a spring fit. It is not as tight a fit as you get with a circumferential taper. The snap ring has less bearing surface so that it is going to wear faster, and the faster it wears, the faster it is going to provide more play between the barrel and the bushing and hence the bushing and the slide. Again Miller is working with the 1911 government model type pistol.

In Schlappich, U.S. Pat. No. 3,110,223, it provides "Reconditioned Firearms." Schlappich is directed to the hand fitting concept of all of the mating parts in a pistol. He is fitting everything up tightly, and then plating everything with hard chrome so as to provide a surface that will not wear. He is working with the basic Colt government style pistol. He is using the government style barrel bushing and what he is doing is hand fitting that bushing around the slides so that he gets as good a tight fit as he possibly can and then he hard chromes these parts, and again he is also working with the slide, where it fits on the frame rail. Schlappich is going over the whole piston whereas Applicant is working with a bushing that attaches to the slide and has a circumferential taper. Applicant has a tapered bushing that provides very good wear resistance and provides exceptionally good seating capabilities, and the taper concept provides an absolute centering capability.

The parts can be made of any suitable material and in different shapes and sizes as desired or required. The bushing and slide contact each other but are not attached to each other.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

I claim:

1. A handgun comprising a barrel, a slide, sight means constructed and arranged on said slide to help align said barrel with a target and including an accurizer for said handgun to lessen a tendency for said barrel to become misaligned with said target when said handgun fires a projectile from said barrel, said accurizer comprising, in combination, (a) a muzzle end portion of said barrel having a short length of lesser outside diameter than a given diameter of a portion of said barrel extending rearward of said muzzle end portion, said muzzle end portion having an outside surface that is threaded, (b) a tapered bushing having an internal bore threaded to mate with said threaded outside surface of said muzzle end portion, a rear end portion having an outside diameter equal to that of said rearward extending portion of said barrel and tapering in an axially forward direction to a larger outside diameter than that of said rearward extending portion of said barrel, and (c) a slide having an inside surface with a diameter at least equal to said given diameter so that said slide can make a sliding fit with said rearward extending portion of said barrel arranged in circumferential relation to said barrel, said inner surface of said slide having a forward end portion constructed and arranged to provide a taper essentially identical to the taper of the outside surface of said tapered bushing; whereby said forward tapered end portion of said inside surface of said slide tightly engages said tapered outside surface of said tapered bushing when said handgun is fired.

2. A handgun as in claim 1, provided with a said accurizer having a said tapered bushing whose length is at least equal to said short length of said muzzle end portion of said barrel.

3. A handgun as in claim 1, wherein said muzzle end portion of said accurizer comprises a portion whose outer surface is first machined to said lesser outside diameter and then threaded along its machined outside surface after being machined.

* * * * *